US010163565B2

(12) United States Patent
Hofste et al.

(10) Patent No.: US 10,163,565 B2
(45) Date of Patent: Dec. 25, 2018

(54) METHOD FOR WINDING A MULTI-LAYER FLAT WIRE COIL

(71) Applicant: Tecnotion B.V., Almelo (NL)

(72) Inventors: Erwin Gerardus Bernardus Hofste, Vasse (NL); Roel Toon Hendrik Huinink, Neede (NL)

(73) Assignee: TECNOTION B.V., Almelo (NL)

( * ) Notice: Subject to any disclaimer, the term of this patent is extended or adjusted under 35 U.S.C. 154(b) by 131 days.

(21) Appl. No.: 15/034,754

(22) PCT Filed: Nov. 7, 2014

(86) PCT No.: PCT/NL2014/050771

§ 371 (c)(1),
(2) Date: May 5, 2016

(87) PCT Pub. No.: WO2015/069109

PCT Pub. Date: May 14, 2015

(65) Prior Publication Data

US 2016/0260543 A1 Sep. 8, 2016

(30) Foreign Application Priority Data

Nov. 7, 2013 (NL) ..... 2011753

(51) Int. Cl.
*H01F 7/06* (2006.01)
*H01F 41/074* (2016.01)
(Continued)

(52) U.S. Cl.
CPC ..... *H01F 41/074* (2016.01); *H01F 41/073* (2016.01); *H01F 41/082* (2016.01);
(Continued)

(58) Field of Classification Search
CPC ..... Y10T 29/49071; Y10T 29/49002; Y10T 29/4902; Y10T 29/49069; Y10T 29/53143; H01F 41/061; H01F 5/00; H01F 41/074
(Continued)

(56) References Cited

U.S. PATENT DOCUMENTS 4,484,974 A 11/1984 Rothman
7,201,344 B2 * 4/2007 Higeta ..... H01F 27/2823 242/437
7,626,478 B2 * 12/2009 Kawai ..... H01F 27/2847 335/299

FOREIGN PATENT DOCUMENTS

EP 2001093767 6/2001
EP 2004180367 6/2004
(Continued)

OTHER PUBLICATIONS

PCT Search Report & Written Opinion dated Jan. 16, 2016 (Application No. PCT/NL2014/050771).

*Primary Examiner* — Thiem Phan
(74) *Attorney, Agent, or Firm* — The Dobrusin Law Firm, PC

(57) ABSTRACT

The present invention is related to a method for winding a dual-layer flat wire coil, and to method for winding a multi-layer flat wire coil. Furthermore, the present invention is related to a device for winding such coils and to a dual-layer flat wire coil and to a multi-layer flat wire coil obtainable by performing the method of the present invention. Finally, the invention is related to a linear motor comprising such a dual-layer flat wire coil and/or multi-layer flat wire coil. According to the invention, an auxiliary winding core is used to temporarily store wire that is intended to form the odd layer of any pair of layers in the multi-layer coil.

8 Claims, 20 Drawing Sheets

(51) Int. Cl.

| | |
|---|---|
| ***H01F 41/088*** | (2016.01) |
| ***H01F 41/073*** | (2016.01) |
| ***H01F 41/082*** | (2016.01) |
| ***H01F 41/12*** | (2006.01) |

(52) U.S. Cl.
CPC ..... *H01F 41/088* (2016.01); *H01F 41/122* (2013.01); *Y10T 29/49071* (2015.01)

(58) Field of Classification Search
USPC ..... 29/605, 604, 606, 732
See application file for complete search history.

(56) References Cited

FOREIGN PATENT DOCUMENTS

| | | |
|---|---|---|
| EP | 2629310 | 8/2013 |
| GB | 1235041 | 7/1968 |

* cited by examiner

METHOD FOR WINDING A MULTI-LAYER FLAT WIRE COIL

FIELD

The present invention is related to a method for winding a dual-layer flat wire coil, and to a method for winding a multi-layer flat wire coil. Furthermore, the present invention is related to a device for winding such coils and to a dual-layer flat wire coil and to a multi-layer flat wire coil obtainable by performing the method of the present invention. Finally, the invention is related to a linear motor comprising such a dual-layer flat wire coil and/or multi-layer flat wire coil.

BACKGROUND

Flat wire coils are known in the art. Such coils can for instance be used as the active component in linear motors. In such applications, a flat wire coil is typically wound from wire that has a substantially rectangular cross section. These wires are typically on the order of ten times thinner than they are wide.

Rectangular wires are interesting because the windings made from such wires stack better than round wire. A larger portion of the coil (by volume) is taken up by the conductor. Consequently, a coil having wire with a rectangular cross section typically shows a higher fill factor. This results in a lower resistance or a more compact design.

The wire to be used comprises a conductive core and an insulating jacket. The electric core conducts heat well, whereas the insulator conducts heat rather poorly. A higher fill factor allows the temperature of the coil to be lower allowing a more reliable and/or accurate operation.

In a linear motor, the flat wire coil is typically mounted on a cooling plate. The flat wire coil comprises a disc of wound wire, wherein the disc comprises a plurality of windings. The disc is mounted such that the windings lie against the cooling plate to ensure efficient cooling. This works best with a flat wire coil comprising a single layer. Alternatively, a flat wire coil having two layers or two flat wire coils each with a single layer mounted on top of each other may equally be used. Cooling may be performed on both sides.

For a given linear motor application one has to optimize the choice of motor as well as the power supply. A certain voltage, current and size of the coils of the motor will be decided on. The current together with the coil resistance determines how much energy is dissipated in the coil. The efficiency of the motor is typically above 90%, sometimes even 99%, but the generated heat still has to be transported away. Providing a heat conduction path to the environment is essential to keep the motor from burning out. Moreover, the thermal resistance combined with a given maximum operating temperature, determines the allowable current for the motor. Reducing the thermal resistance would increase motor performance (force) by allowing higher currents before the motor overheats.

To obtain a high thermal conductivity of the coil, the fill factor must be optimized. Given that some space in the coil is lost to the finite thickness of the insulator that surrounds the conductive core, a close packing of windings must be used to reduce this lost space. Geometrically, the optimum would be wire with a square cross section, because when filling up a rectangular area with many small shapes, rectangles are the most efficient, and the rectangle with the smallest circumference (which represents the insulator) is the square. However, the fill factor is not the only consideration.

Choosing a rectangle with a high aspect ratio gives the possibility to cross a significant part of the thickness of the coil with an unbroken copper "heat bridge". In other words, the number of layers of insulator to cross is reduced for the heat to find its way out of the coil. However, the number cannot reach zero. There is always at least one layer of insulator between the conductor of the coil and the conductor of the motor housing.

So the engineering trade-off is between heat production and heat transport. The number of layers, combined with the thickness of the insulator and its thermal properties, yield an effective thermal resistance. The fill factor determines the heat dissipation. These two together determine the maximum continuous force the motor can generate while staying within a given specified temperature.

There are many industrial applications that require linear motion. Some of these require high accuracy, in the order of nanometers, with high accelerations and travel speed. Examples of such applications are pick-and-place machines and various applications in the semiconductor, solar panel and display manufacture industries. These motion requirements are suitably addressed by Linear Permanent Magnet Synchronous Motors (LPMSM).

Over time, more and more stringent requirements are placed on the linear motors. Thermal management becomes important for the following reasons. The continuous power output of a motor is ultimately limited by its ability to conduct heat out to an external heat sink. Furthermore, an uncontrolled heating up of any part of the construction leads to thermal expansion, which leads to positioning errors.

Through Ohmic dissipation, the coils are the main source of heat in a motor. At the same time, the largest thermal resistance is usually found in these same coils. For this reason, the traditional round wire coils are sometimes replaced by flat wire coils which combine lower heat dissipation with lower thermal resistance. This can be further optimized by choosing the number of layers in such a flat wire coil.

By increasing the number of windings in a coil, for instance by increasing the number of layers, the total amount of force to be exerted by the motor can be increased. However, flat wire coils of several layers are difficult to assemble with tight mechanical tolerances. Furthermore, when optimizing the fill factor, the insulator thickness is necessarily reduced which leads to enhanced risk of discharges between adjacently arranged layers. Additionally, when winding flat wire coils of a single layer, and then combining several of them in a stack, the number of process steps is high, and some of these carry a high risk of failure, such as soldering steps.

SUMMARY

An object of the present invention is to provide a flat wire coil having at least a pair of layers in which the above-mentioned problems do not occur or at least to a lesser extent.

This object has been achieved with the method as defined in claim 1.

DETAILED DESCRIPTION

Figure 1B:
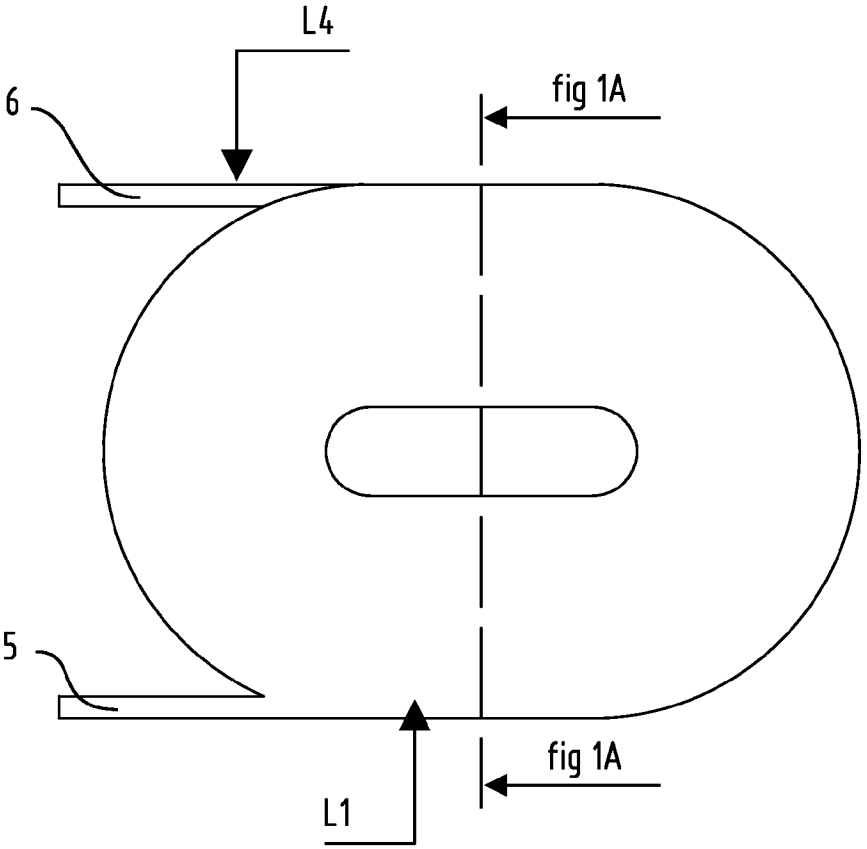
FIGS. 1A and 1B illustrate a schematic cross-section and top view of a four-layer flat wire coil.

According to the invention, a method for winding a dual-layer flat wire coil is provided that comprises the steps of providing a wire supply, providing a winding core, and providing an auxiliary winding core.

First, an end of wire from the wire supply is optionally clamped on the auxiliary winding core. This end will later serve as a terminal of the coil. Next, in step d) wire from the wire supply is wound onto the auxiliary winding core, wherein a length of wire wound onto the auxiliary winding core substantially equals a length of wire required for an odd layer of a pair of layers of the dual-layer flat wire coil. Wire that extends between the auxiliary winding core and the wire supply is optionally clamped on the winding core. Next, in step e) wire from the wire supply is wound onto the winding core to form an even layer of the pair of layers of the dual-layer flat wire coil. This wire may be cut in between the winding core and the wire supply to provide a terminal of the coil.

To continue, the wire from the auxiliary winding core is wound onto the winding core to form the odd layer in step f). Wire that extends between the even layer and the auxiliary winding core prior to winding of the odd layer may optionally be clamped on the winding core to assist the winding of the odd layer. Alternatively, the even layer itself provides sufficient fixation of the wire for winding the odd layer.

The method according to the invention provides a dual-layer flat wire coil wherein terminals are provided by the wires on the outer windings of the coil. This is a clear advantage over other types of coil, including single layer flat wire coils, because no extra space is required to lead the terminal on the inner winding outward.

Step e) may comprise revolving the wire supply around the winding core or rotating the auxiliary winding core and the winding core together relative to the wire supply.

Additionally or alternatively, step f) may comprise revolving the auxiliary winding core around the winding core or vice versa. The even layer is preferably connected on one end to the wire supply and on another end to the odd layer, which is in the process of being wound. In this case, step f) may comprise keeping the winding core fixed relative to the wire supply while revolving the auxiliary winding core around the winding core.

Step d) may comprise rotating the auxiliary winding core relative to the wire supply or revolving the wire supply around the auxiliary winding core.

The method of the present invention may further comprise using guides comprised by the winding core to guide the wire to be wound onto the winding core in a circumferential groove that extends radially.

The wire supply may be arranged stationary. In this case, step e) comprises rotating the winding core about a first rotation axis which is at a fixed distance from the wire supply. Furthermore, step d) may comprise rotating the auxiliary winding core about a second rotation axis which is at a fixed distance from the wire supply. The first and second rotation axes may be identical, and typically refer to the mathematical abstract concept of an imaginary axis of rotation. A rotational shaft that extends along the first rotation axis may be provided, which shaft is capable to rotate about the first rotation axis. In this case, step d) may comprise locking the auxiliary winding core onto the shaft and rotating the shaft, and step e) may comprise locking the auxiliary winding core and the winding core onto the shaft and rotating the shaft. Here, locking implies any type of coupling which ensures that at least rotation of one element, such as the auxiliary winding core, necessarily results in the same rotation of another element, such as the winding core.

A revolving arm may be provided that is capable of revolving an end thereof around the first rotation axis. In this case, step f) comprises locking the auxiliary winding core on the end of the revolving arm and revolving the arm.

As stated before, the wire that extends between the even layer and the wire supply may be cut to provide a first terminal of the dual-layer flat wire coil. The end of wire from the wire supply that was optionally clamped onto the auxiliary winding core may provide a second terminal.

According to a second aspect, the present invention provides a method for winding a multi-layer flat wire coil. This method comprises the steps of winding a pair of layers as described above while keeping the even layer connected to the wire supply. As a next step, a further winding core is provided and the auxiliary winding core and the winding core of the previously formed pair of layers are mutually locked. The auxiliary winding core is arranged in between the winding core of the previously formed pair of layers and the further winding core. Next, the wire that extends between the even layer of the previously formed pair of layers and the wire supply is optionally clamped on the auxiliary winding core. Next, a pair of layers is formed onto the further winding core as described in conjunction with the dual layer flat wire coil while keeping the auxiliary winding core and the winding core of the previously formed pair of layers locked. After winding the odd layer of the pair of layers, the auxiliary winding core and the winding core of the previously formed pair of layers are unlocked. A small piece of wire exists between the previously formed pair of layers and the currently formed pair of layers. In fact, this small piece of wire accommodated the placement of the auxiliary winding core. To provide a compact coil, the winding core and the further winding core are rotated relative to each other while moving them towards each other in an axial direction to tightly wind the remaining wire between the winding core and the further winding core around the winding core and/or the further winding core. In this way, the remaining piece of wire between the two pairs becomes part of the windings on both pairs.

This method may be repeated to form a plurality of adjacently arranged pairs of layers. Each time, a separate further winding core is used. It is noted that the winding core and the further winding cores may be coupled in their axial direction such that a single core can be obtained. At the same time it is noted that such core(s) may be removed after fabrication. In such case, the (further) winding core is an accessory to facilitate the winding of the coils. It has no physical function after the winding has been completed.

An insulator layer, such as a polyimide foil or a ceramic plate, may be inserted in between the odd and even layer prior to winding the odd layer, as well as prior to stacking two adjacently arranged pair of layers.

To make this possible, a cache of suitable foils must be made available prior to the start of the winding process. The foils must have the same cross section as the coils, e.g. an ovoid with a central hole. The wire must be passed through the holes of at least the required number of foils prior to winding. The resulting layer reduces the probability of an electrical discharge between the windings of the different layers.

The wire may comprise a conductive core, an insulating jacket, and an adhesive layer arranged on an outer surface of the insulating jacket. The method may further comprise pressing the formed layers together while heating the coil, or otherwise allowing the adhesive layer to generate a bonding between the layers. The winding cores and any other tooling is preferably removed after the bonding is complete.

According to a third aspect, the present invention provides a device for forming the abovementioned dual-layer or multi-layer flat wire coil using the method described above. The device comprises a wire supply, a rotational shaft that extends along a rotation axis and which is capable to rotate about the rotation axis. It further comprises a revolving arm that is capable of revolving an end thereof around the rotation axis, and an auxiliary winding core that is configured to be able to lock to the rotational shaft and/or to the revolving arm and/or to the winding core. The device also comprises a winding core that is configured to be able to lock to the rotational shaft and/or to the auxiliary winding core.

The device preferably comprises a further winding core, wherein the further winding core is configured to be able to lock to the rotational shaft and/or to the auxiliary winding core.

Guiding means may be provided as part of the winding core and/or the further winding core to guide the wire to be wound onto the winding core and/or further winding core in a circumferential groove that extends radially.

According to a fourth and fifth aspect, the present invention provides a dual-layer flat wire coil and a multi-layer flat wire coil, respectively, obtainable by performing the method as described above.

According to a sixth aspect, the present invention provides a linear motor that comprises the abovementioned dual-layer flat wire coil and/or multi-layer flat wire coil.

Figure 1A:
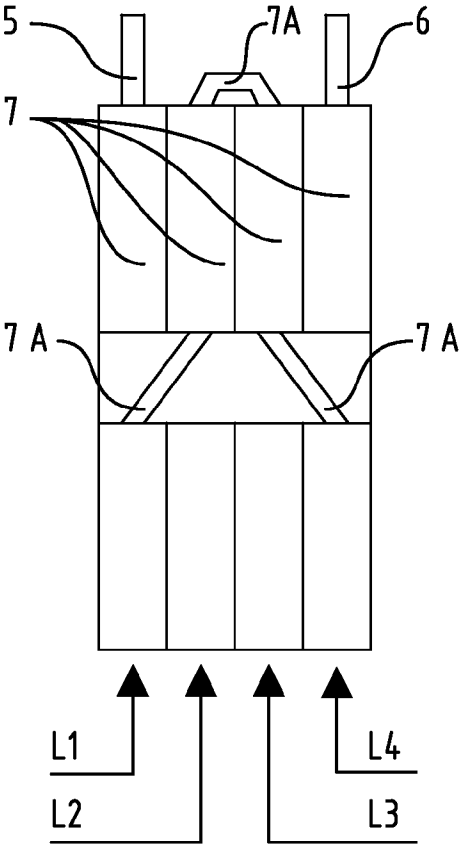
Figure 1C:
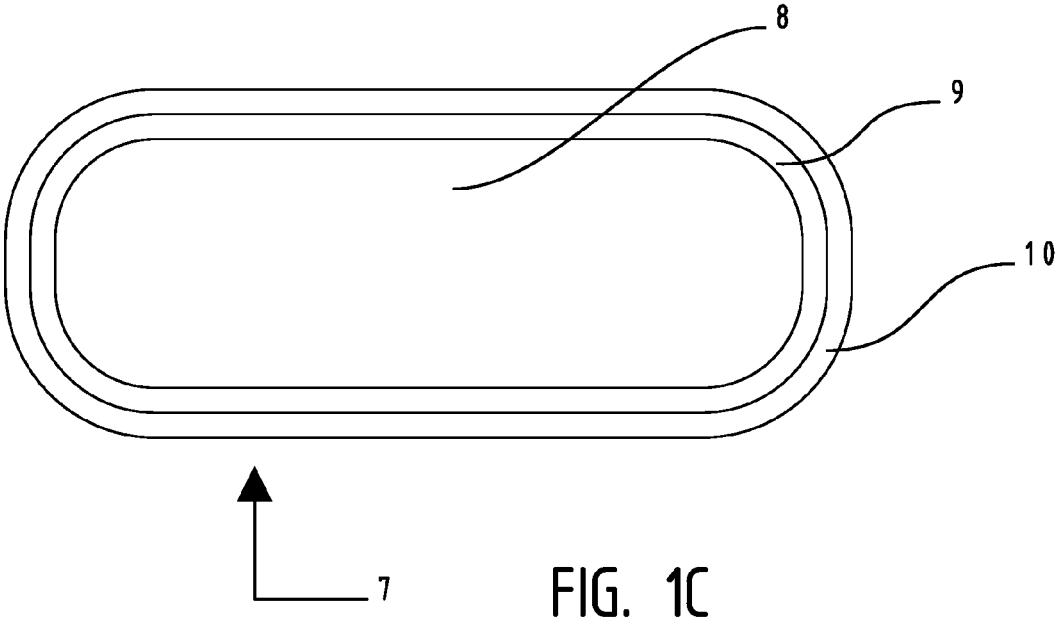
FIG. 1C illustrates a cross-section of a wire of a four-layer flat wire coil.
Figure 2A:
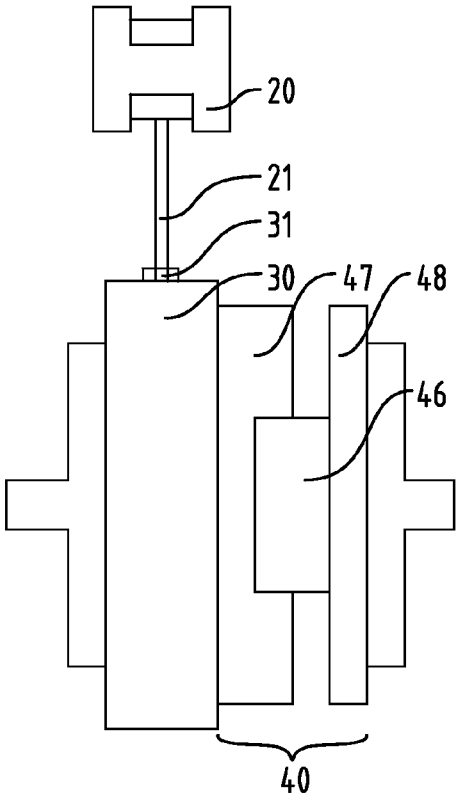
FIGS. 2A-2O illustrate a method for forming a four-layer coil.
Figure 3A:
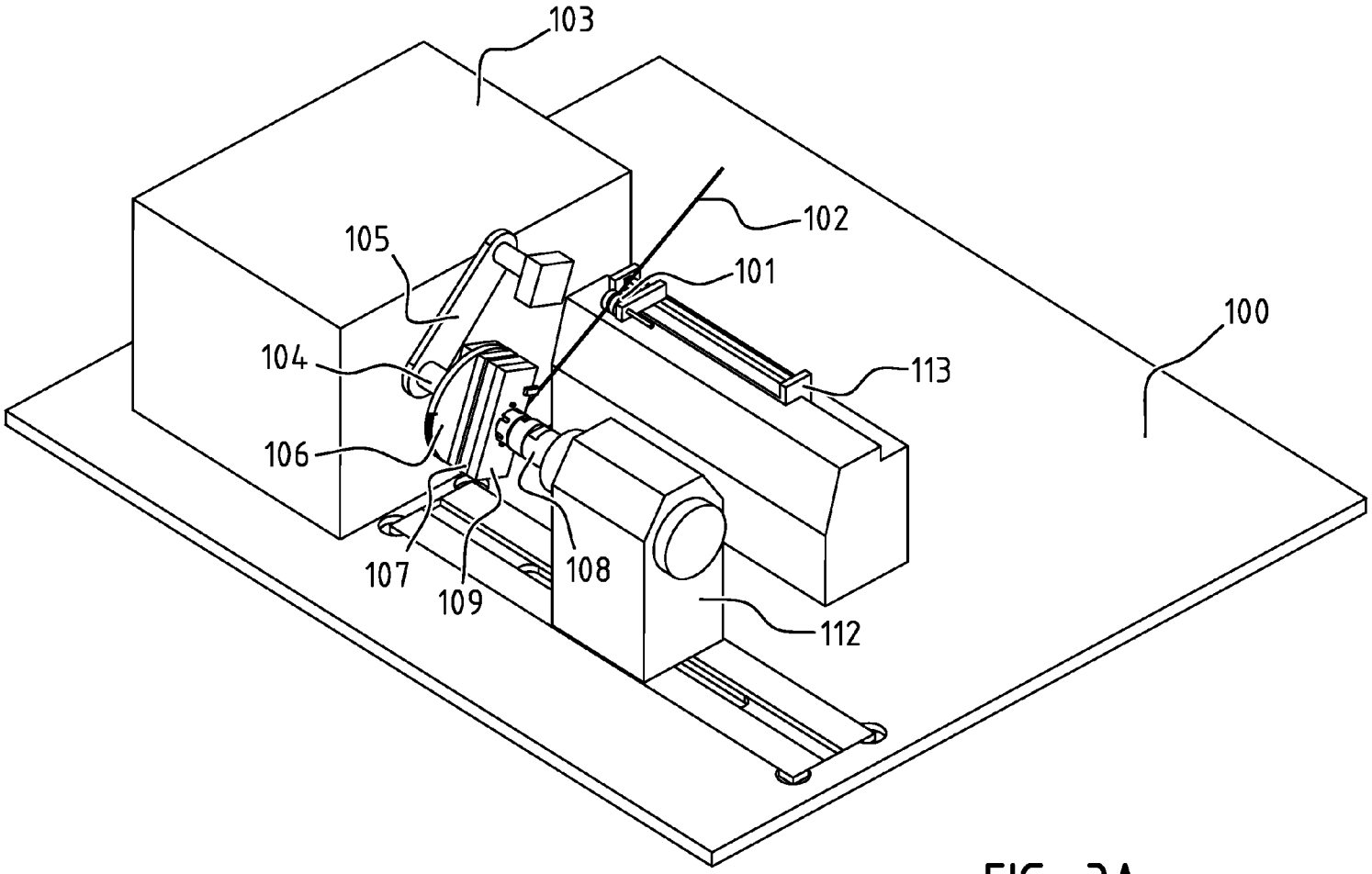
FIGS. 3A-3N illustrate close-up perspective views of a device for winding the coil of FIG. 1A.
Figure 3B:
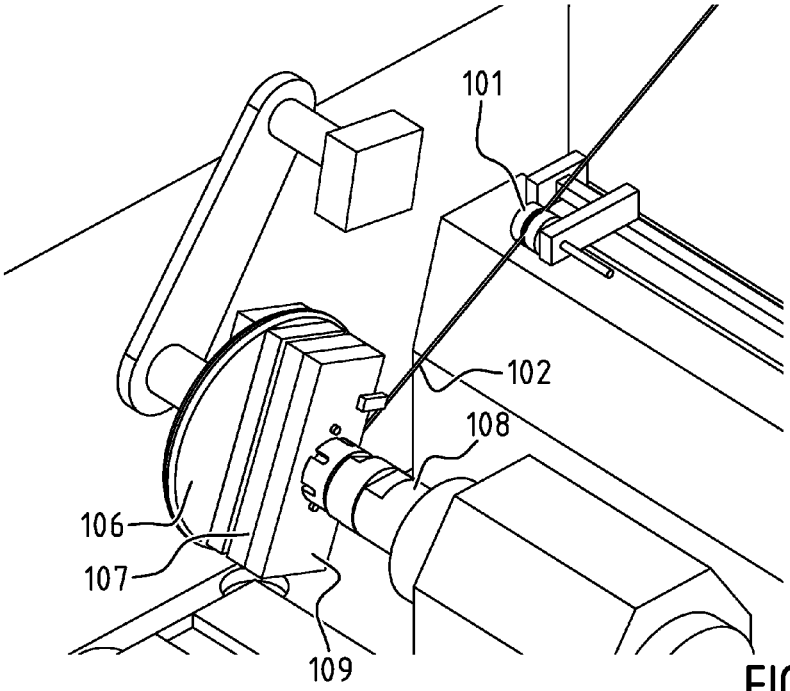
Figure 3C:
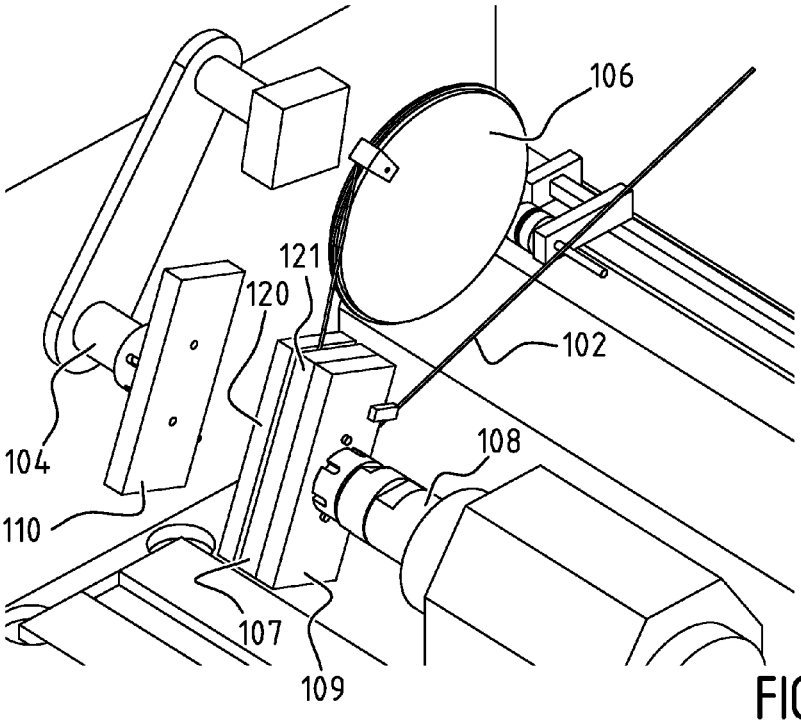
Figure 3D:
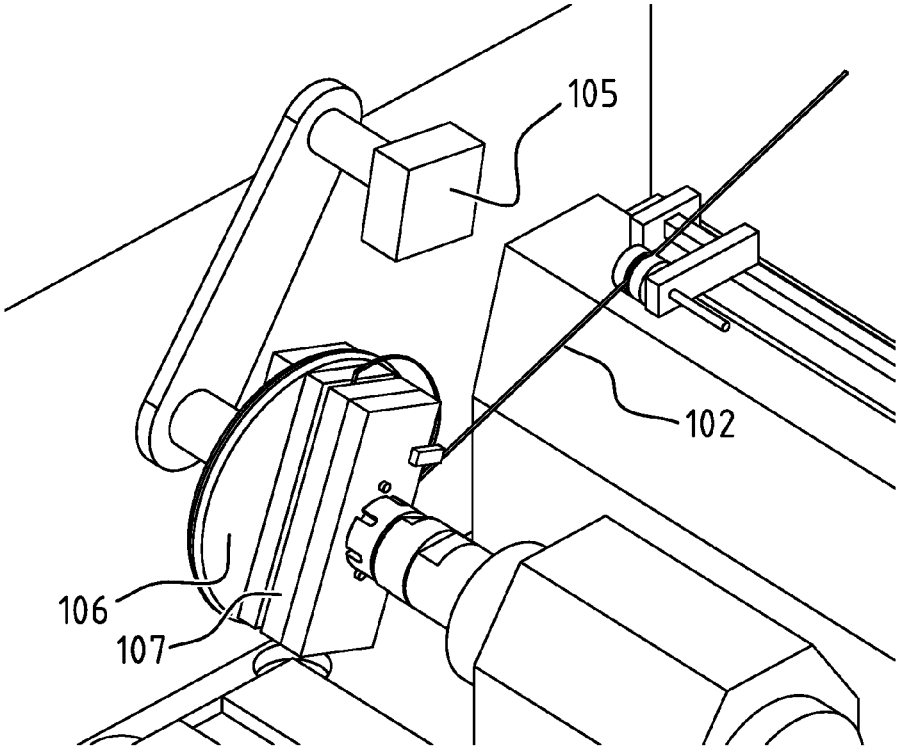
Figure 3E:
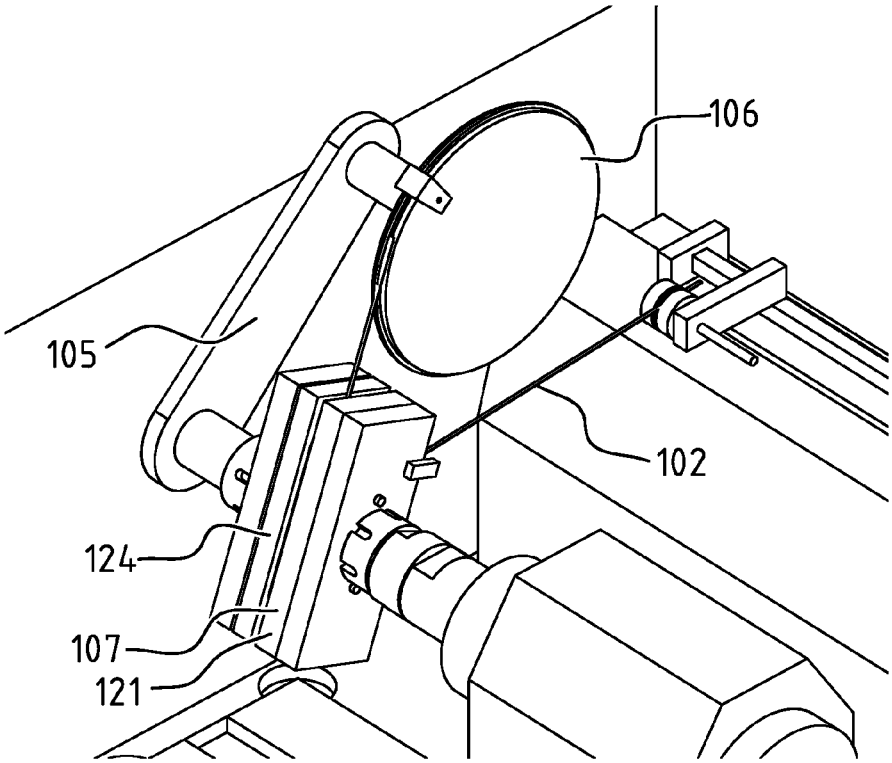
Figure 3F:
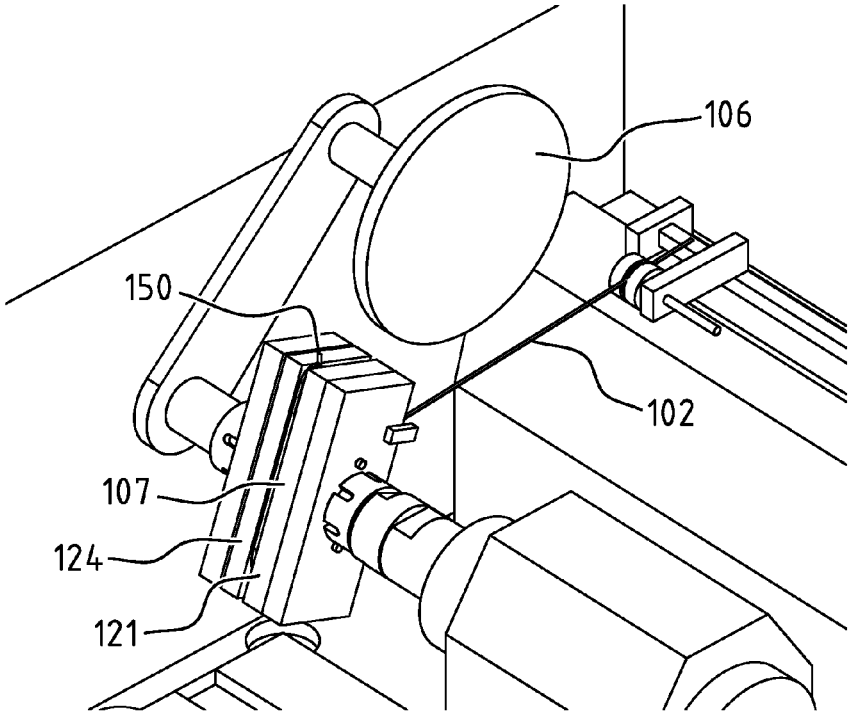
Figure 3G:
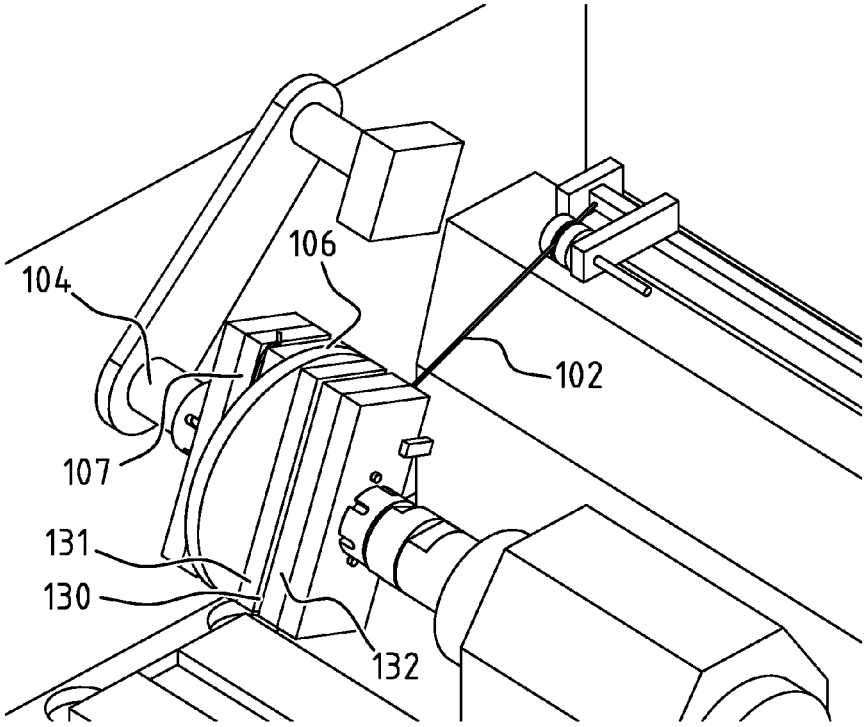
Figure 3H:
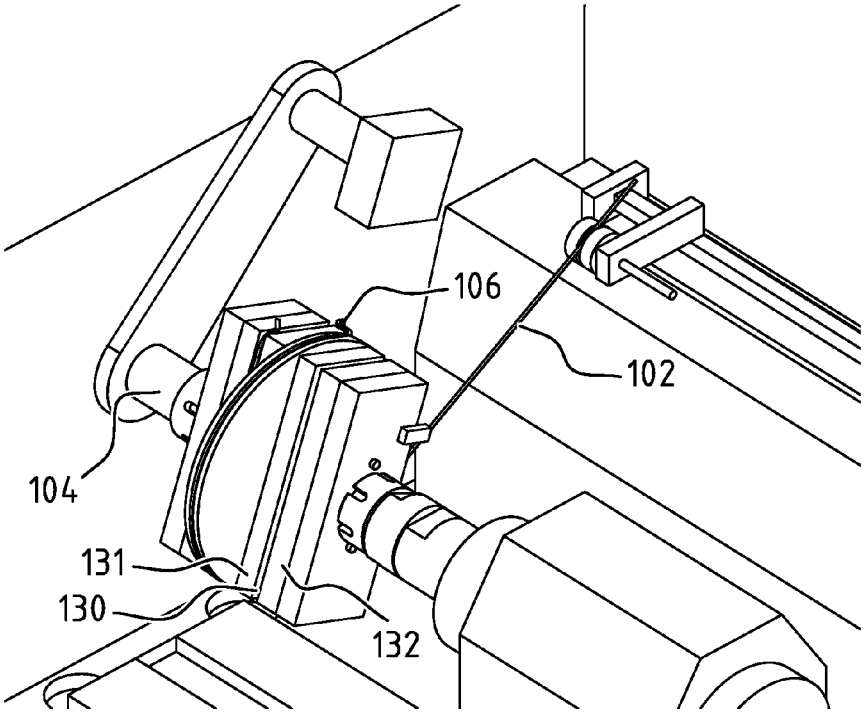
Figure 3I:
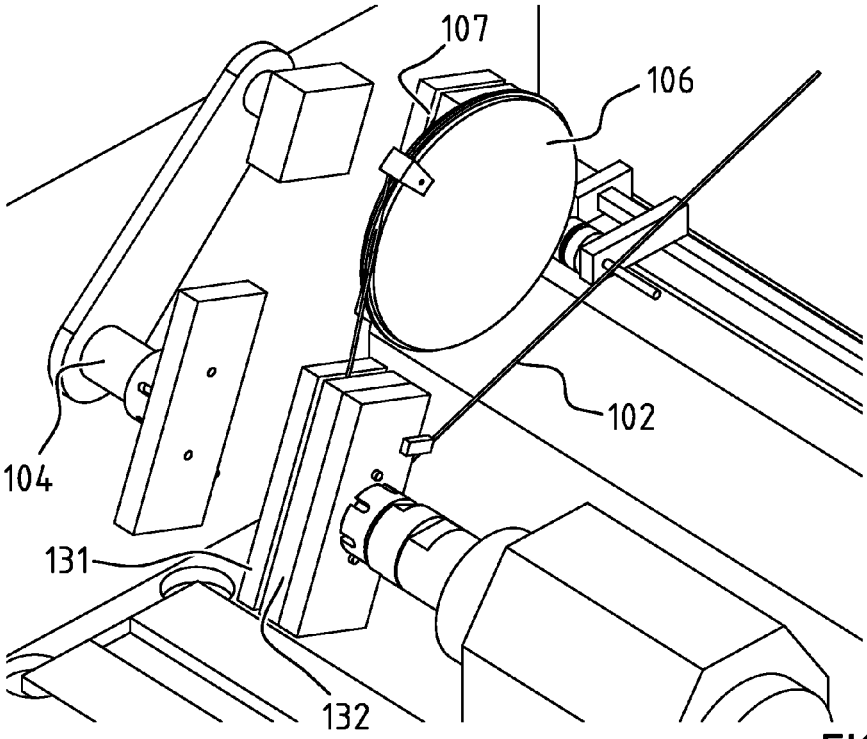
Figure 3J:
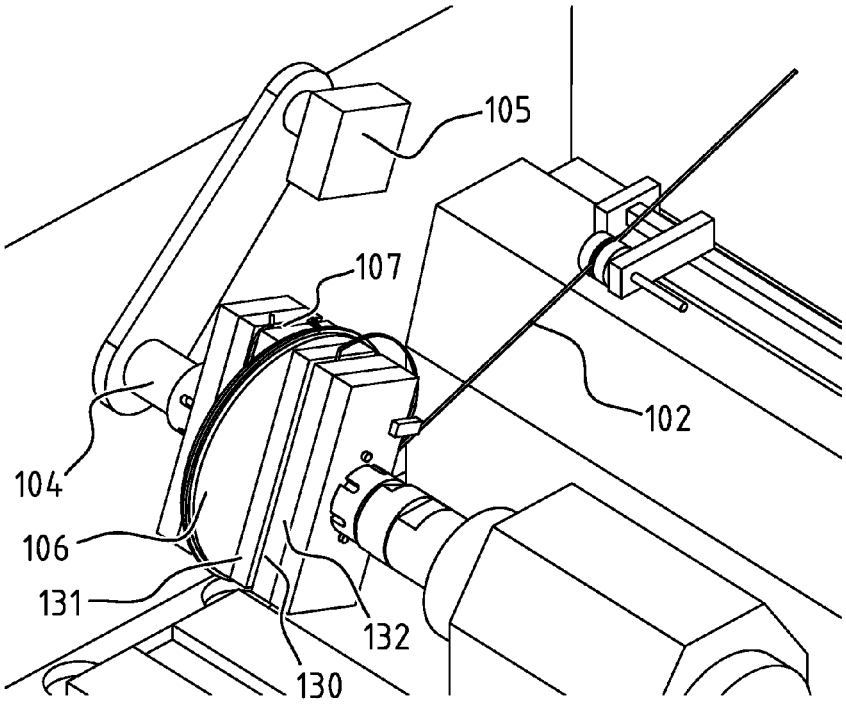
Figure 3K:
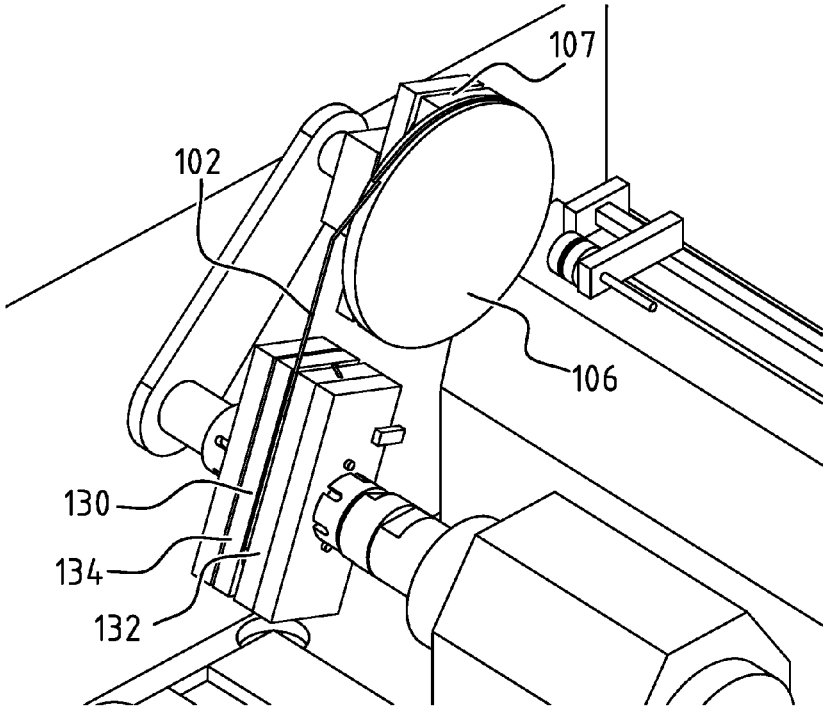
Figure 3L:
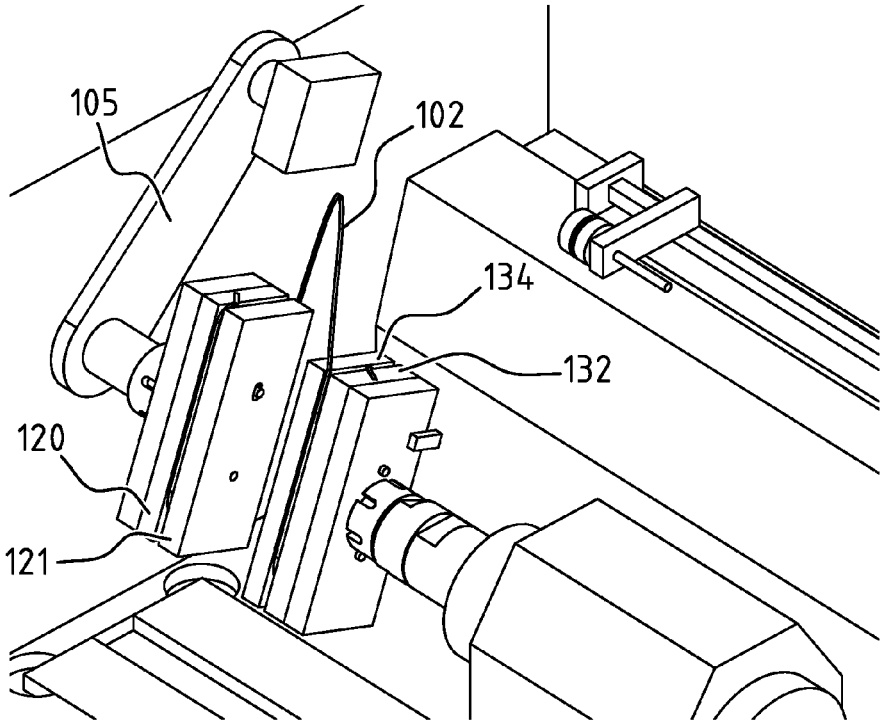
Figure 3M:
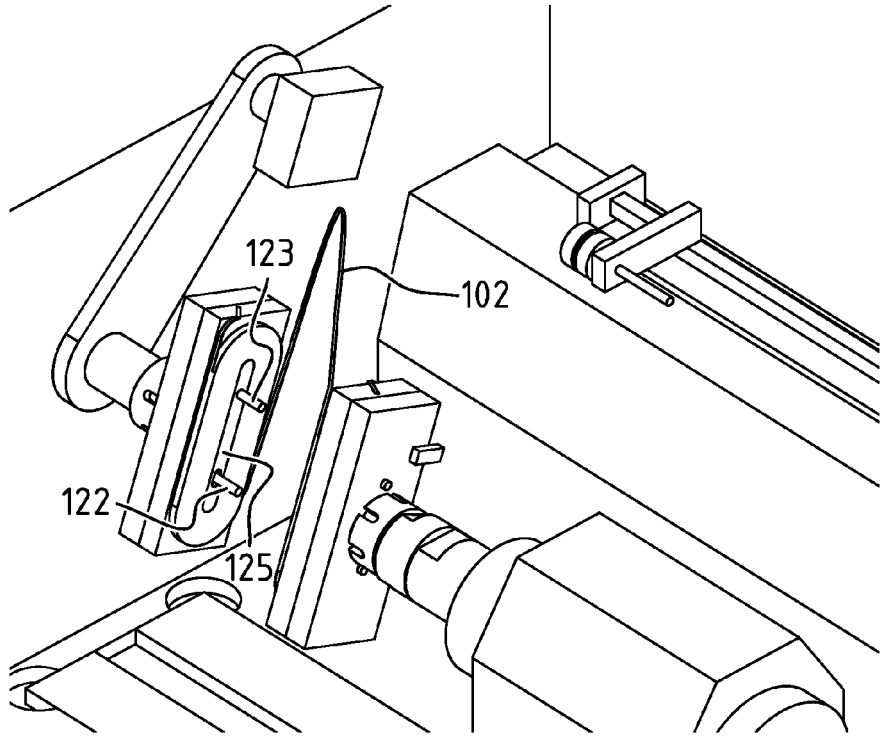
Figure 3N:
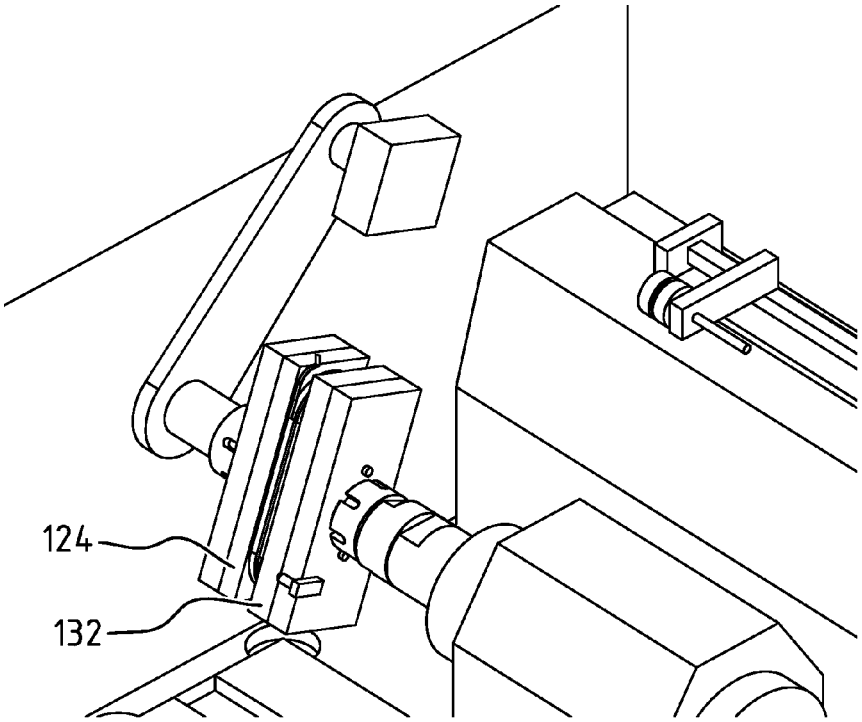

Next, the invention will be described in more detail, referring to the appended drawings, in which:

FIGS. 1A and 1B show a schematic cross section and top view of a four-layer flat wire coil made using the method according to the invention, respectively, and FIG. 1C illustrates a cross section of the wire used for this coil, respectively;

FIGS. 2A-2O schematically illustrate a method for forming a four-layer coil in accordance with the invention; and FIGS. 3A-3N illustrate an embodiment of a device for winding the coil of FIG. 1A in accordance with the invention.

FIG. 1A illustrates a cross section of a four-layer coil made in accordance with the present invention. Layers 1-4 (L1-L4) can be identified that each comprise multi-turn windings of wire 7. Terminals 5, 6 can be used to apply an electrical signal to the coil. These terminals illustrate how electrical signals can be applied to the coil and how these terminals are connected to the various layers.

FIG. 1B shows a top view of the coil in FIG. 1A. In a linear motor application, the coil is mounted with the top, as shown in FIG. 1B, and/or bottom side to a cooling plate.

Wire 7, shown in cross section in FIG. 1C, has a rectangular cross section and comprises a conductive core 8, for instance made of copper, and an insulating jacket 9, for instance made of polyimide. On the outside, an adhesive layer 10 is arranged which allows layers 1-4 to be connected by means of heating. However, other means than an adhesive layer may be equally used.

The four-layer coil comprises two pairs of layers. Each pair comprises an odd layer 1, 3 and an even layer 2, 4. The wording odd and even refers to the order on the finalized product. However, the even layers are wound onto the winding core before their corresponding odd layers, which are first wound onto the auxiliary winding core and are then wound onto the winding core (after the corresponding even layers). The sequence is then 2, 1, 4, 3, etc.

For a typical linear motor application, the width of wire 7 is in the range of 0.5 through 5 mm, and its height in the range of 0.1 through 1 mm. Each layer of the four layer coil may have typically 50 through 200 turns, wherein the winding core to be used has an outer dimension of about 10 through 100 mm.

FIGS. 2A-2O schematically illustrate a method for forming a four layer coil in accordance with the invention.

In FIG. 2A, a wire supply 20, an auxiliary winding core 30, and a winding core 40 are schematically illustrated. Winding core 40 comprises two flanges 47, 48 on either side thereof which are removably connected to an inner core 46 of winding core 40. FIG. 2A schematically illustrates that inner core 46 of winding core 40 is partially received in flange 47.

FIG. 2A schematically illustrates the first optional step of the method, i.e. clamping a wire 21 from wire supply 20 onto auxiliary winding core 30. Here, box 31 indicates the position where wire 21 is optionally clamped. Clamping refers to the process of attaching wire 21 to auxiliary winding core 30 such that clamped wire 21 or at least an end thereof remains substantially fixed during the winding of wire 21.

Figure 2B:
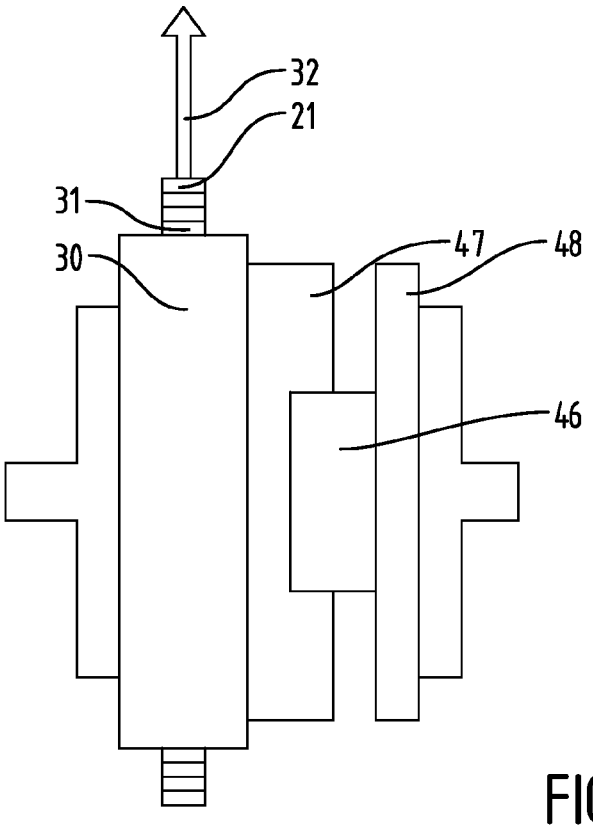

FIG. 2B schematically illustrates a cross section of the end result of winding wire 21 onto auxiliary winding core 30. Arrow 32 indicates that wire 21 is still connected to wire supply 20. The length of wire 21 that is wound onto auxiliary winding core 30 corresponds to substantially the length of wire that is required for an odd layer of the first pair of layers of the four-layer coil.

Figure 2C:
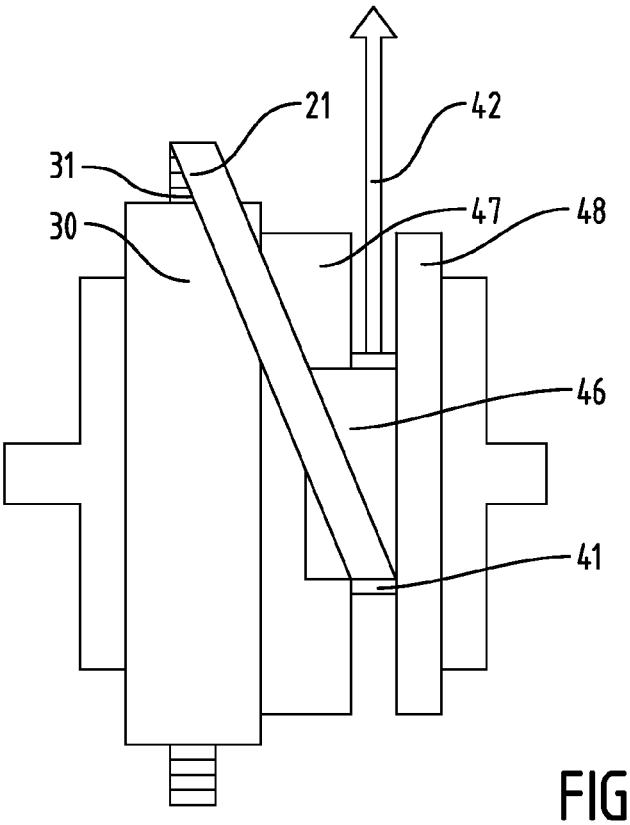

In FIG. 2C, the next step is illustrated. Here, wire 21 that extends between auxiliary winding core 30 and wire supply 20 is optionally clamped on winding core 40 as indicated by box 41. Arrow 42 indicates that wire 21 is still connected to wire supply 20.

Figure 2D:
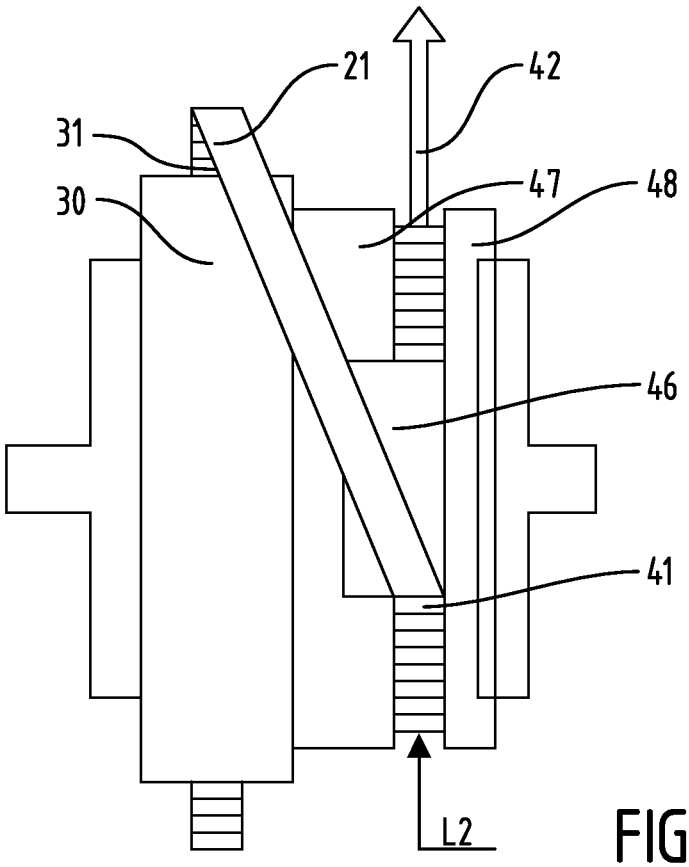

Next, wire 21 from wire supply 20 is wound onto winding core 40 to form even layer 2 of the first pair, see FIG. 2D. It is preferred to couple or lock auxiliary winding core 30 and winding core 40 such that they may rotate as a single unit with respect to wire supply 20. Normally, wire supply 20 is stationary and provides wire 21 when a pulling force is exerted on wire 21.

Figure 2E:
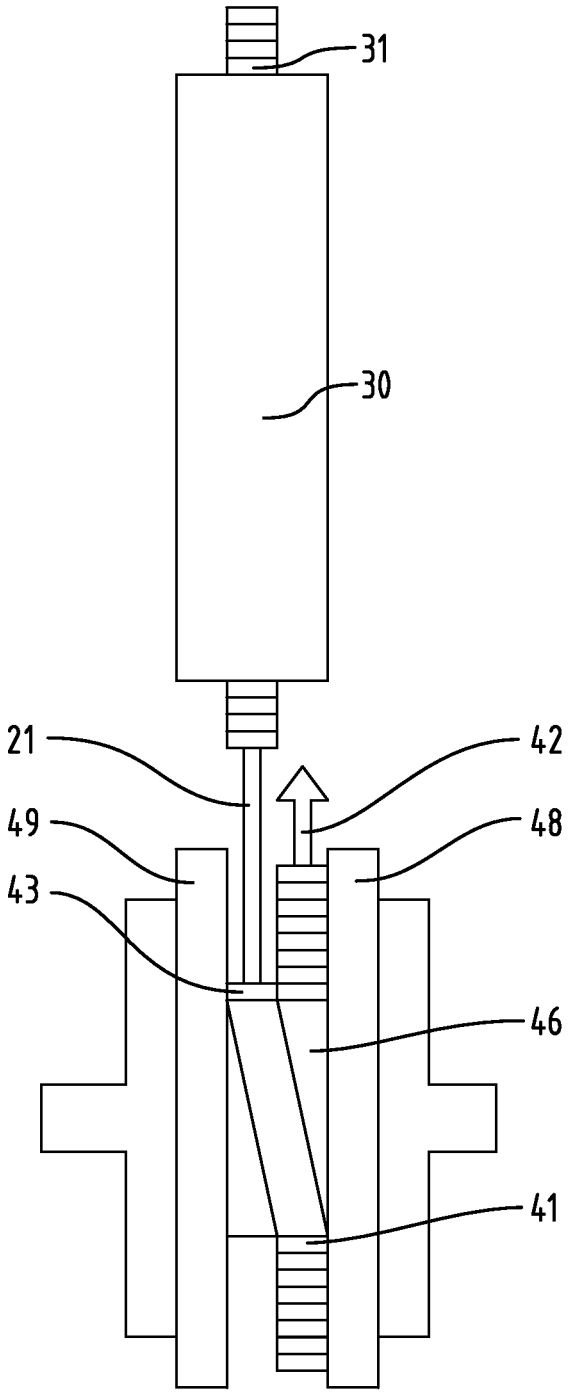

As a next step, auxiliary winding core 30 is uncoupled, see FIG. 2E. In addition, flange 47 is replaced by flange 49. Unlike flange 47, inner core 40 is not partially received, or at least not to the same extent, in flange 49. This allows space next to L2 to be formed for winding L1.

Next, auxiliary winding core 30 is revolved around winding core 40 as a result of which wire 21 on auxiliary winding core 30 is unwound onto winding core 40 thereby forming odd layer 1. To facilitate the winding of odd layer 1, wire 21 that extends between even layer 2 and auxiliary winding core 30 may be optionally clamped on winding core 40 prior to winding odd layer 1, as illustrated by box 43. However, in most situations layer 2 will itself provide sufficient fixation.

Figure 2F:
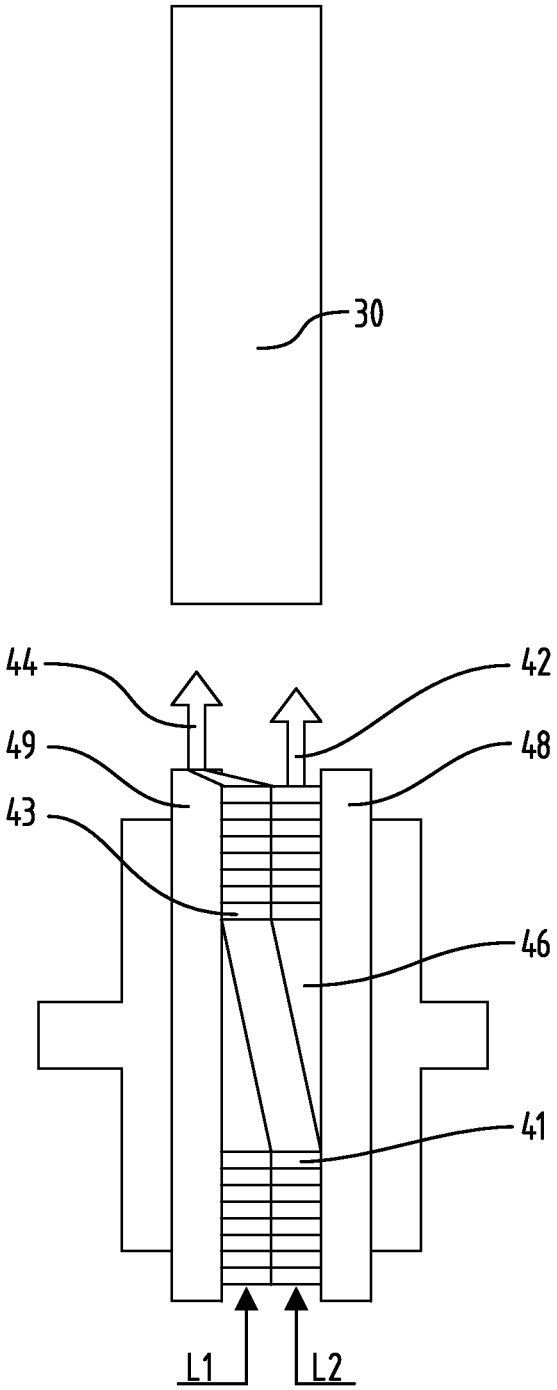

FIG. 2F illustrates how even layer 2 and odd layer 1 are present on winding core 40. Here, arrow 44 indicates an end of wire 21. If wire 21 is cut near arrow 42, a first terminal is created. The second terminal is formed by the end of wire 21 near arrow 44. By cutting wire 21 at this stage, a dual-layer coil can be obtained.

Figure 2G:
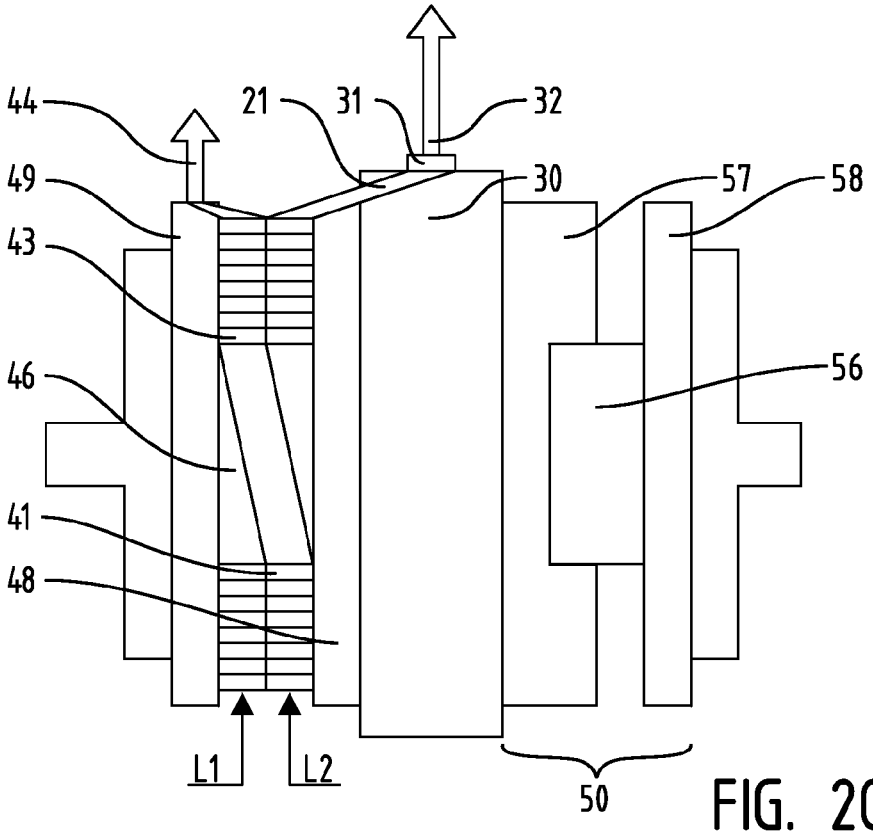

Next, a further winding core 50 is provided. Further winding core 50 comprises two flanges 57, 58 on either side thereof which are removably connected to an inner core 56 of further winding core 50. FIG. 2G schematically illustrates that inner core 56 of further winding core 50 is partially received in flange 57. Auxiliary winding core 30 is disposed between further winding core 50 and winding core 40. Furthermore, auxiliary winding core 30 and winding core 40 are mutually coupled or locked to ensure that they rotate as a single unit. Wire 21 that extends between even layer 2 of the previously formed pair and wire supply 20 is optionally clamped on auxiliary winding core 30 as indicated by box 31 in FIG. 2G. Again arrow 32 indicates that wire 21 is still connected to wire supply 20.

Figure 2H:
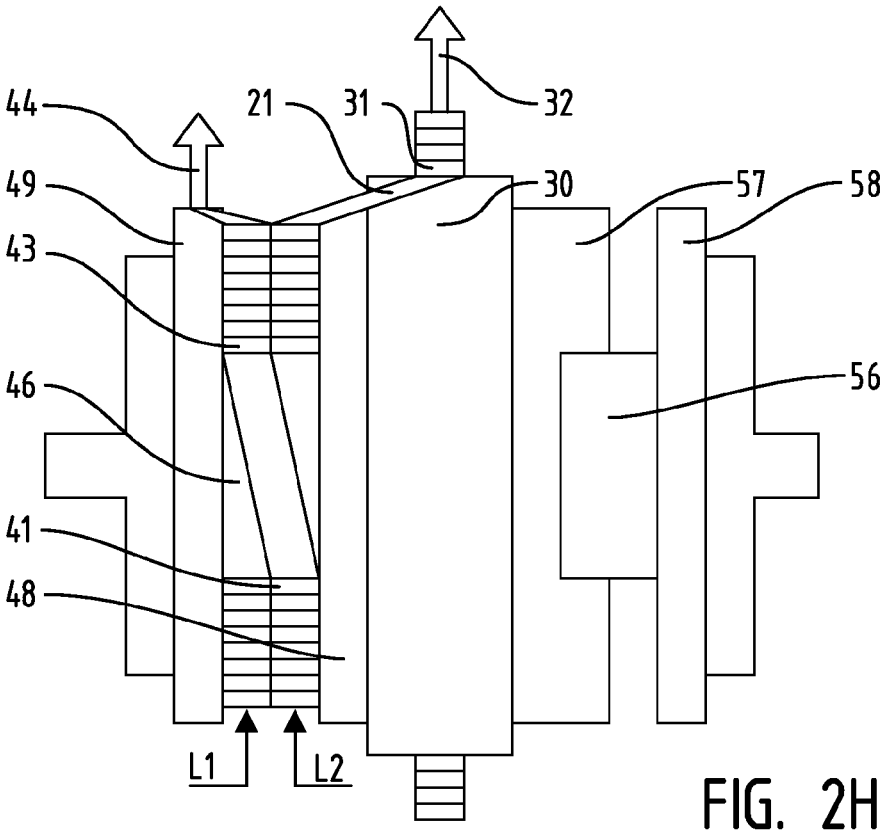

Next, auxiliary winding core 30 and winding core 40 are rotated to wind wire 21 onto auxiliary winding core 30. Here, a length of wire 21 to be wound onto auxiliary winding core 30 substantially corresponds to the length of wire 21 that is required for odd layer 4. A result of the winding process is illustrated in FIG. 2H.

Figure 2I:
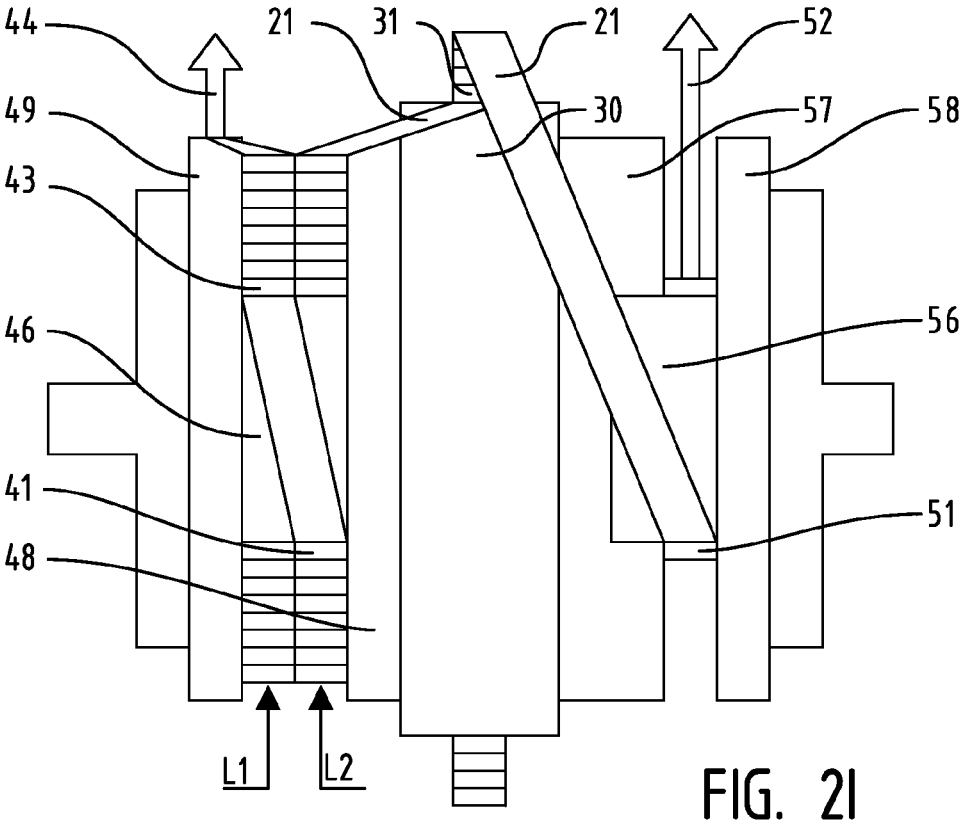

FIG. 2I illustrates how wire 21 is optionally clamped onto further winding core 50 as a next step. The clamping is indicated by box 51. Furthermore, arrow 52 indicates that wire 21 is still connected to wire supply 20.

Figure 2J:
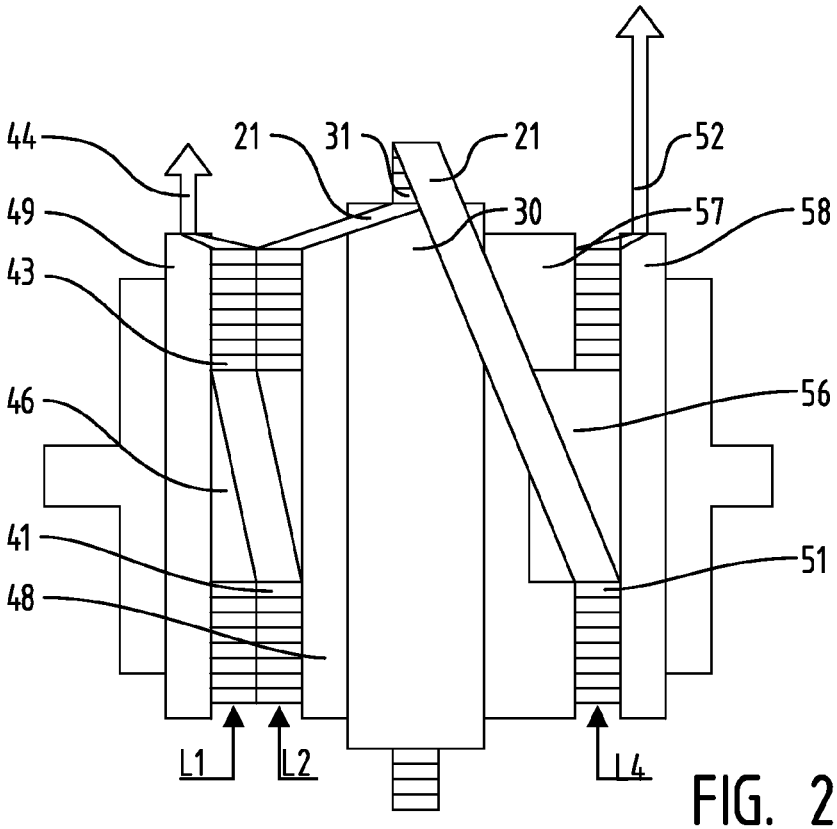

Next, wire 21 from wire supply 20 is wound onto further winding core 50 to form even layer 4 of the second pair, see FIG. 2J. It is preferred to couple or lock auxiliary winding core 30, winding core 40, and further winding core 50 such that they may rotate as a single unit with respect to wire supply 20.

Figure 2K:
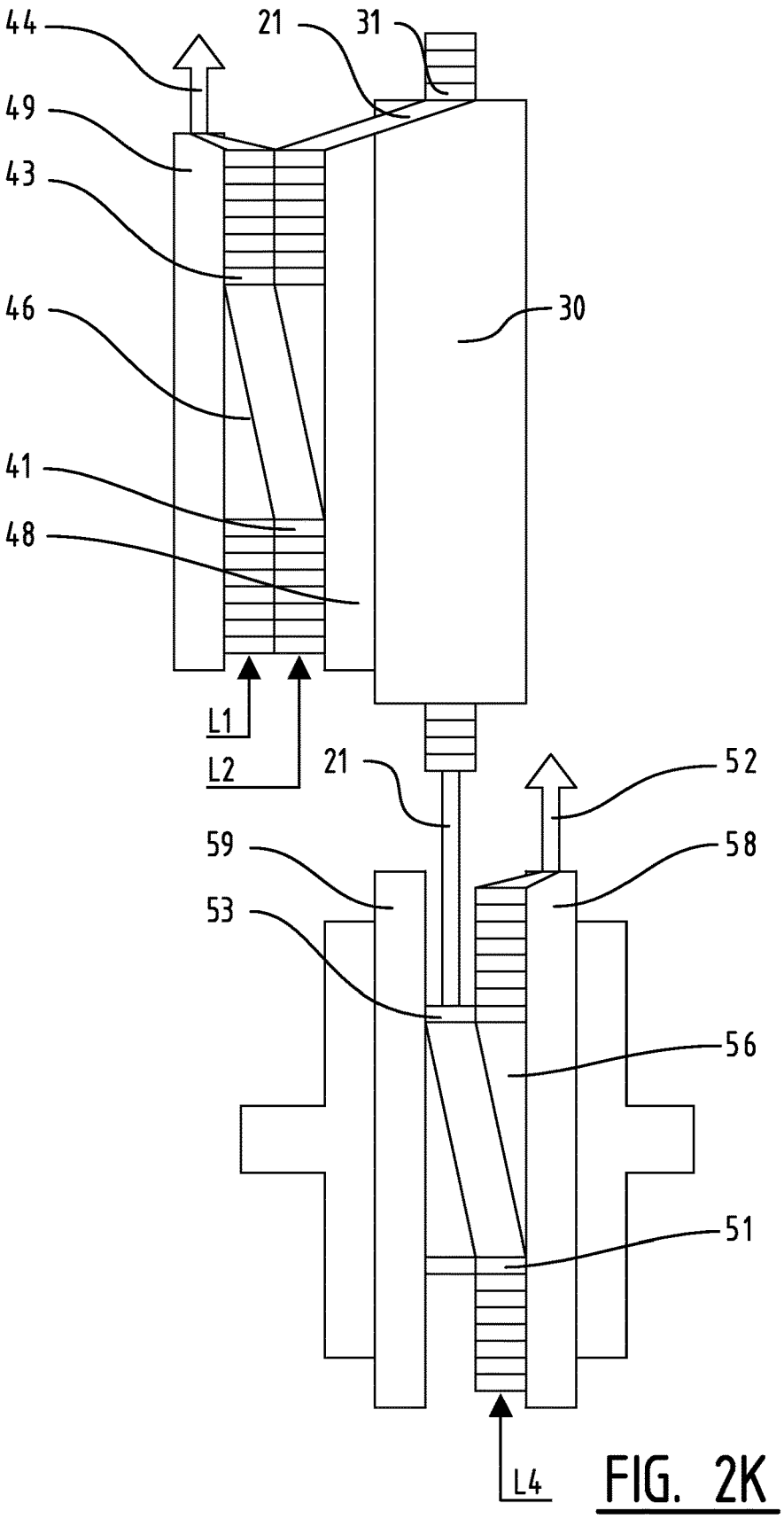

As a next step, auxiliary winding core 30 and winding core 40 are uncoupled from further winding core 50, see FIG. 2K. In addition, flange 57 is replaced by flange 59. Unlike flange 57, inner core 56 is not partially received, or at least not to the same extent, in flange 59. This allows space next to L4 to be formed for winding L3. Next, auxiliary winding core 30 and winding core 40 are revolved around further winding core 50 as a result of which wire 21 on auxiliary winding core 30 is unwound onto further winding core 50 thereby forming odd layer 3. To facilitate the winding of odd layer 3, wire 21 that extends between even layer 4 and auxiliary winding core 30 may be optionally clamped on further winding core 50 prior to winding odd layer 3, as illustrated by box 53. However, it most situations layer 4 will itself provide sufficient fixation.

Figure 2L:
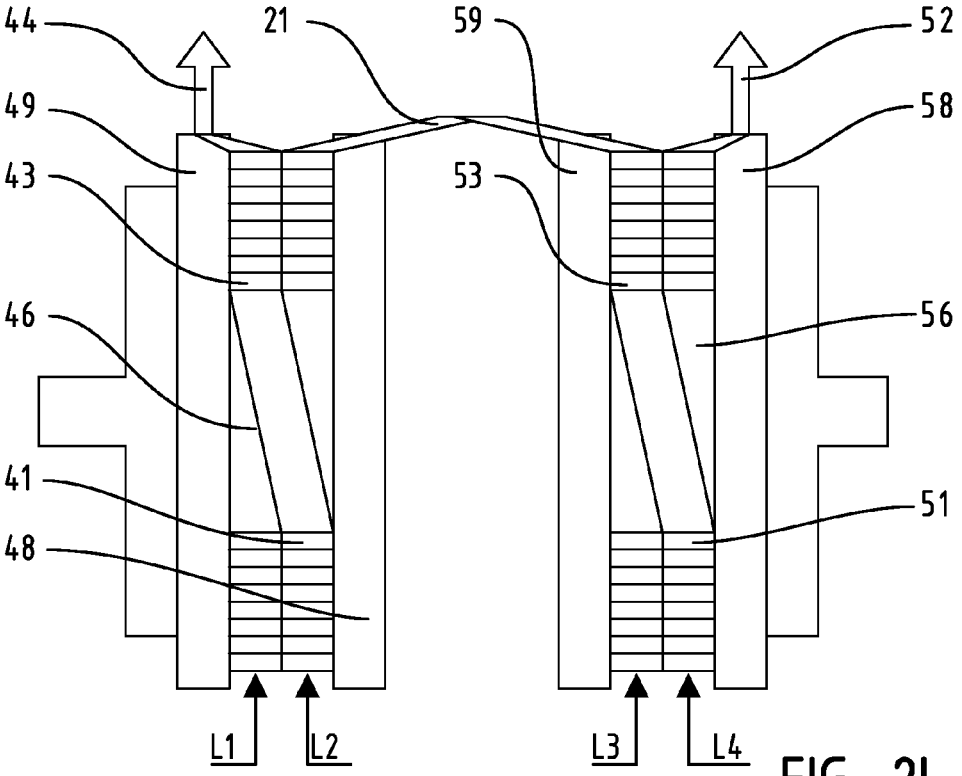

FIG. 2L illustrates how even layer 4 and odd layer 3 are wound onto further winding core 50. If wire 21 is cut near arrow 52, a first terminal is created. The second terminal is formed by the end of wire 21 near arrow 44.

Figure 2M:
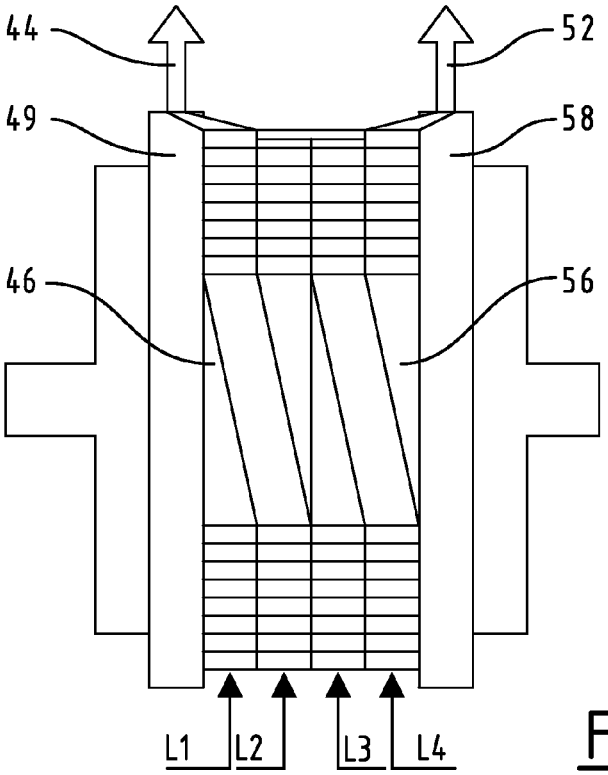

FIG. 2L also illustrates how wire 21 extends from layer 3 to layer 2. FIG. 2L further illustrates that auxiliary winding core 30 was uncoupled from further winding core 50 and winding core 4 and was subsequently removed. The piece of wire 21 between layer 3 and layer 2 is wound onto layer 3 and layer 2 by rotating winding core 40 and further winding core 50 relative to each other while at the same time moving both towards each other in the axial direction. As a result, the four-layer coil illustrated in FIG. 2M is obtained.

Figure 2N:
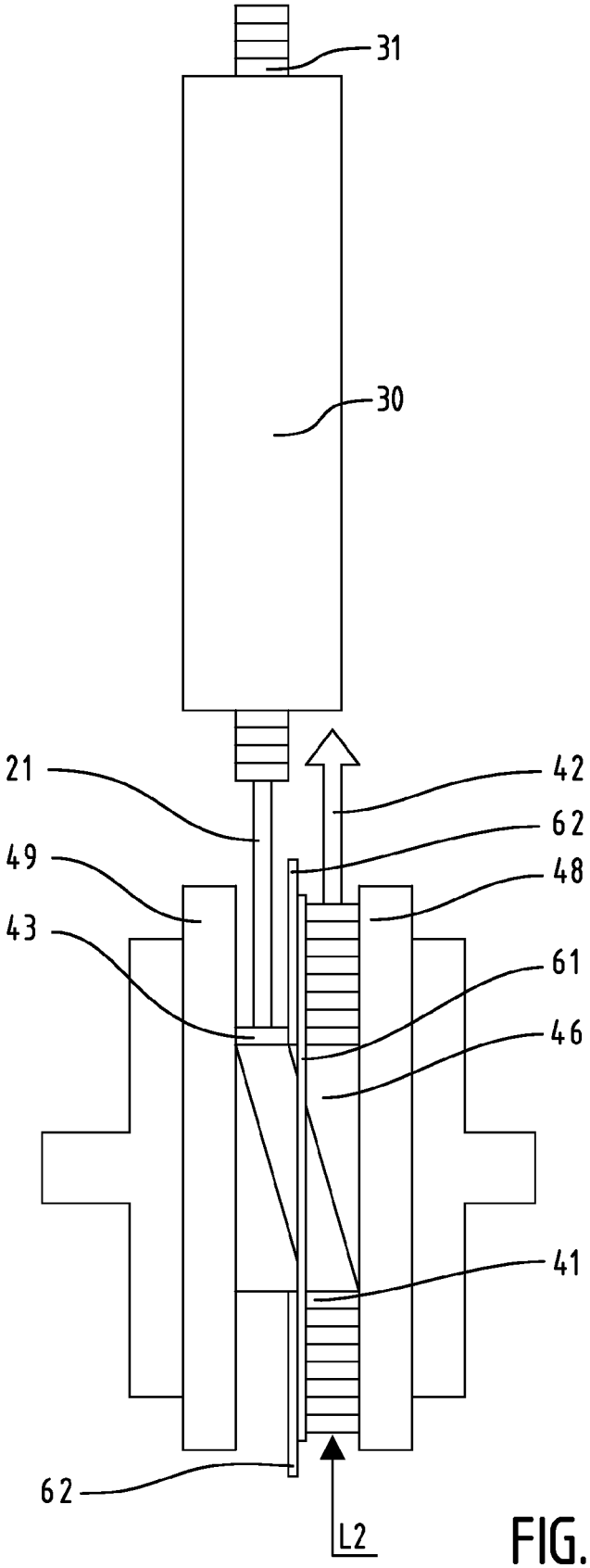
Figure 20:
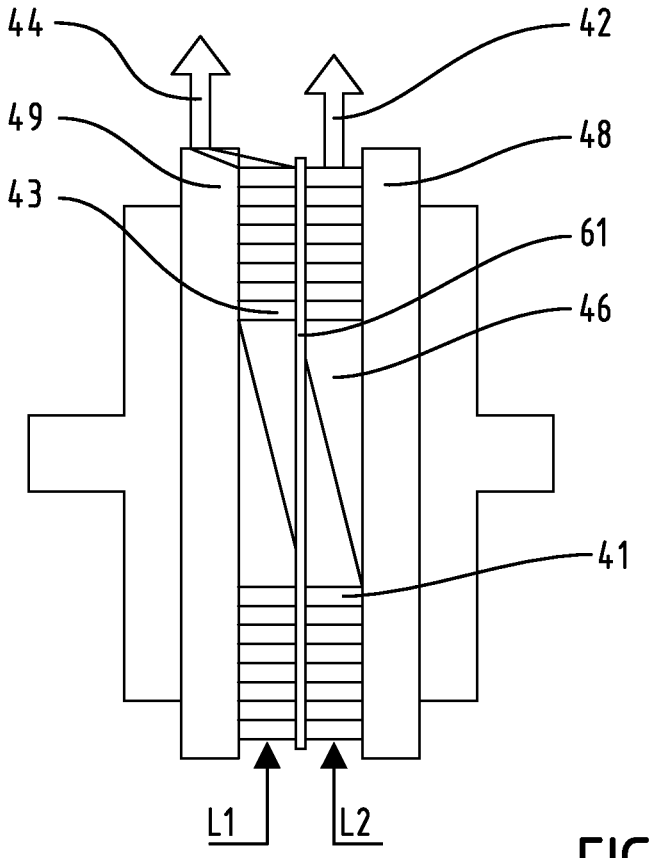

FIGS. 2N and 2O show a modification of the method described above. In FIG. 2N, a step is illustrated wherein an insulation foil, such as Kapton, a polyimide film, has been inserted to provide electrical isolation between L1 and L2.

The insulation foil is typically provided as a disc 61 having an opening that is slightly larger than the outer dimensions of inner core 46 and/or inner core 56. Prior to winding wire 21 onto auxiliary winding core 30, disc 61 of insulation foil is inserted such that it is arranged in between auxiliary winding core 30 and wire supply 20 in FIG. 2A. In practice, wire 21 can be fed through the opening in disc 61 towards auxiliary winding core 30. After winding L2, during which disc 61 remains in between auxiliary winding core 30 and inner core 46, auxiliary winding core 30 is removed and flange 47 is removed. This allows the disc to be mounted onto inner core 46. A protective sleeve 62, preferably made of a metal, may additionally be placed that protects disc 61 during the winding of L1. Such sleeve 62 typically comprises two or more connectable parts allowing sleeve 62 to be mounted onto inner core 46 without breaking wire 21. After mounting disc 61 onto inner core 46, flange 49 is connected and L1 is wound onto inner core 46 in a manner similar to what is shown in FIG. 2E. After winding L1, protective sleeve 62 can be removed. During a final compression and baking step, L1 and L2 are brought closer together and a single compact coil is formed having additional isolation between the different layers provided by disc 61.

In a similar manner, an insulation foil may be provided between L3 and L4 and even between L2 and L3. The discs that are required in the final coil should all be arranged in between auxiliary winding core 30 and wire supply 21 prior to winding L2 as described above. Each respective disc can be mounted on the appropriate inner core 46, 56 at a suitable time during the process. For isolation between layers L3 and L4, such time corresponds to FIG. 2K, i.e. after removal of flange 57 and prior to connecting flange 59. For isolation between layers L2 and L3, the disc can remain as is. After removal of auxiliary winding core 30, the disc is advantageously arranged in between L2 and L3 as can be derived from FIG. 2L. In all cases, protective sleeves may be used if required.

FIGS. 3A-3N illustrate a device 100 for winding the four layer coil of FIG. 1. Device 100 comprises a wire guide 101 that guides a wire 102 from a wire supply (not shown). A typical wire supply comprises a spool. Device 100 further comprises an electrical motor 103 that has a rotational shaft 104, see also FIG. 3C. Device 100 further comprises a revolving arm 105 that may rotate independently from rotational shaft 104.

An auxiliary winding core 106 is shown which is used to temporarily store wire 102. A winding core 107 is used as the core onto which the first two layers will be wound.

In FIG. 3A, winding core 107 is locked to a shaft 108 by means of a coupling element 109. Shaft 108 can rotate freely about its axis. Similarly, auxiliary winding core 106 may be locked to rotational shaft 104 by means of coupling element 110, see FIG. 3C. Furthermore, a housing 112 of shaft 108 is able to translate towards motor 103. By doing so, winding core 107 will engage auxiliary winding core 106, causing both cores to rotate as a single unit when electrical motor 103 drives rotational shaft 104. Wire guide 101 is also able to translate along a guide 113 to compensate for any changes in position of winding core 107 or auxiliary winding core 106.

Next, the operation of device 100 will be illustrated using FIGS. 3B-3N. These steps correspond to those illustrated in FIGS. 2A-2M.

As a first step, auxiliary winding core 106 and winding core 107 are coupled or locked and wire 102 is optionally clamped onto auxiliary winding core 106, see FIG. 3B.

Electrical motor 103 urges rotational shaft 106 to rotate, causing wire 102 to be wound onto auxiliary winding core 106.

Next, auxiliary winding core 106 is uncoupled from both winding core 107 and coupling element 110, see FIG. 3C. Wire 102 that extends between auxiliary winding core 106 and wire guide 101 is optionally clamped onto winding core 107. To that end, winding core 107 comprises flanges 120, 121 which together guide wire 102 to be wound onto winding core 107 in a circumferential groove. Flanges 120, 121 can be removed from winding core 107, as illustrated in FIG. 3M. The same figure shows two pins 122, 123 which can be used to couple flanges 120, 121. Typically, winding core 107 comprises an inner core 125 having an elongated structure that defines the inner dimensions and shape of the four-layer coil. Pins 122, 123 extend through holes in inner core 125.

FIG. 3D shows the next step in which wire 102 is wound onto winding core 107 thereby forming even layer 2 of the first pair of layers. To that end, auxiliary winding core 106 is first locked again to coupling element 110 and housing 112 is moved such that shaft 108 presses winding core 107 against auxiliary winding core 106, such that both cores are locked in rotation. By rotating rotational shaft 104, wire 102 is wound onto winding core 107.

As a next step, auxiliary winding core 107 is uncoupled and mounted on revolving arm 105, see FIG. 3E, and flange 120 is replaced by flange 124. Contrary to flange 120, flange 124 does not, or not as much, receive a part of inner core 125 of winding core 107, see FIG. 3M. Consequently, space becomes available for winding L1. Furthermore, wire 102 that extends between auxiliary winding core 107 and winding core 106 may be additionally and optionally clamped onto winding core 107. However, in most situations, even layer 2 will itself provide sufficient clamping for wire 102. Revolving arm 105 is rotated while winding core 107 is kept fixed. This allows auxiliary winding core 106 to revolve around winding core 107 allowing wire 102 from auxiliary winding core 106 to be wound onto winding core 107 thereby forming odd layer 1 of the first pair of layers. Here, wire guide 101 can be adjusted in position to prevent wire 102 extending from wire guide 101 to block revolving arm 105. As a result, all of the wire from auxiliary winding core 106 will be wound onto winding core 107, as shown in FIG. 3F. An end 150 of wire 102 can be seen, which will later serve as one of the terminals of the four-layer coil.

To wind the second pair of layers, a further winding core 130 is used that comprises flanges 131, 132 similar to flanges 120, 121. FIG. 3G illustrates how auxiliary winding core 106 is disposed in between winding core 107 and further winding core 130. Both winding core 107 and further winding core 130 may be provided with suitable recesses and/or protrusions to allow the rotational locking with coupling elements 109, 110 and auxiliary winding core 106.

FIG. 3G illustrates how wire 102 that extends between winding core 107 and wire guide 101 is optionally clamped onto auxiliary winding core 106. Furthermore, as further winding core 130, auxiliary winding core 106, and winding core 107 are locked in rotation, wire 102 is wound onto auxiliary winding core 106 due to the rotation of rotational shaft 104, see FIG. 3H.

In FIG. 3I, auxiliary winding core 106 is again uncoupled. However, in this case, winding core 107 remains coupled to auxiliary winding core 106. Wire 102 that extends between auxiliary winding core 106 and wire guide 101 is optionally clamped onto further winding core 130. In addition, flange 131 is replaced by flange 134. Contrary to flange 131, flange 134 does not, or not as much, receive a part of the inner core of further winding core 130 (not shown). Consequently, space becomes available for winding L3.

After clamping, cores 106, 107, 130 are again brought into rotational locking. Due to rotation of rotational shaft 104, wire 102 is wound onto further winding core 130 thereby forming even layer 4 of the second pair of layers, see FIG. 3J.

Next, auxiliary winding core 106 and winding core 107 are uncoupled and connected to revolving arm 105 as a single unit, see FIG. 3K. Revolving arm 105 is then rotated allowing wire 102 from auxiliary winding core 106 to be wound onto further winding core 130 thereby forming odd layer 3 of the second pair of layers. As stated before in conjunction with layer 1, prior to formation of layer 3, wire 102 may be additionally and optionally clamped on further winding core 130.

After rotation, auxiliary winding core 106 is removed and winding core 107 is mounted to coupling element 110, see FIG. 3L. This figure also shows that a piece of wire 102 remains between further winding core 130 and winding core 107. This piece of wire accommodated the placement of auxiliary winding core 106. This piece has to be distributed between even layer 2 of the first pair and odd layer 3 of the second pair. This is achieved by rotating winding core 107 with respect to further winding core 130 while at the same time moving both cores 107, 130 towards each other by translating housing 112. Prior to rotation, flanges 121, 131 are removed, see FIG. 3M.

After translation and rotation, a four-layer coil is obtained as illustrated in FIG. 3N. Winding core 107 and further winding core 130 can be removed from device 100. Wire 102 is provided with an adhesive layer. By baking winding core 107 and further winding core 130, the separate windings adhere to each other thereby forming a solid coil. By separating winding core 107 and further winding core 130, the four layer coil is exposed and can be taken out as a single unit.

By winding all layers of the multilayer band coil in one process, the end result is faster, requires less operator expertise, is safer (higher process yield) and achieves tighter mechanical tolerances.

According to the invention, the method does not require breaking of the wire to join the first and second pair of layers, which would require a soldering or welding step.

Winding the same number of wires in each layer, and then bonding each layer separately normally leads to a large tolerance on the outside dimensions on the stack of layers. By pressing all layers into conformation simultaneously with a given outside dimension in a single pressing step, dimensional tolerance is improved.

Although the invention has been described using specific embodiments thereof, it should be apparent to the skilled person that various modifications and equivalents are possible without deviating from the scope of the invention which is defined by the appended claims.

The invention claimed is:

1. A method for winding a multi-layer flat wire coil, comprising the steps of:

a) providing a wire supply;

b) providing a winding core;

c) providing an auxiliary winding core;

d) winding wire from the wire supply onto the auxiliary winding core, wherein a length of wire wound onto the auxiliary winding core substantially equals a length of wire required for an odd layer of a pair of layers of the multi-layer flat wire coil;

e) winding wire from the wire supply onto the winding core to form an even layer of the pair of layers of the multi-layer flat wire coil while keeping the even layer connected to the wire supply;

f) winding wire from the auxiliary winding core onto the winding core to form the odd layer;

g) providing a further winding core;

h) mutually locking the auxiliary winding core and the winding core of the previously formed pair of layers;

i) arranging the auxiliary winding core in between the winding core of the previously formed pair of layers and the further winding core;

j) performing steps d)-f) to form a pair of layers onto the further winding core while keeping the auxiliary winding core and the winding core of the previously formed pair of layers locked;

k) unlocking the auxiliary winding core and the winding core of the previously formed pair of layers;

l) rotating the winding core and the further winding core relative to each other while moving them towards each other in an axial direction to tightly wind the remaining wire between the winding core and the further winding core around the winding core, the further winding core, or both.

2. The method according to claim 1, further comprising clamping the wire that extends between the even layer of the previously formed pair of layers and the wire supply on the auxiliary winding core prior to performing step j).

3. The method according to claim 1, comprising repeating steps g)-l) to form a plurality of adjacently arranged pairs of layers.

4. The method according to claim 1, further comprising inserting an insulator layer, such as a polyimide foil, in between the odd and even layer prior to winding the odd layer, as well as prior to stacking two adjacently arranged pair of layers.

5. The method according to claim 1, wherein the wire comprises a conductive core, an insulating jacket, and an adhesive layer arranged on an outer surface of the insulating jacket, the method further comprising pressing the formed layers together while heating the coil, or otherwise allowing the adhesive layer to generate a bonding between the layers.

6. The method according to claim 1, wherein the wire has a rectangular cross-section.

7. The method according to claim 1, wherein the method includes use of a device comprising:

a wire supply;

a rotational shaft extending along a rotation axis and being capable to rotate about the rotation axis;

a revolving arm that is capable of revolving an end thereof around the rotation axis;

an auxiliary winding core that is configured to be able to lock to the rotational shaft and/or to the revolving arm and/or to the winding core;

a winding core that is configured to be able to lock to the rotational shaft and/or to the auxiliary winding core; and a further winding core, wherein the further winding core is configured to be able to lock to the rotational shaft, to the auxiliary winding core, or both.

8. The device according to claim 7, further comprising guiding means as part of the winding core and/or the further winding core to guide the wire to be wound onto the winding core, the further winding core, or both in a circumferential groove that extends radially from the winding core and/or the further winding core.

* * * * *